US006049932A

United States Patent [19]

Mangone

[11] Patent Number: 6,049,932

[45] Date of Patent: Apr. 18, 2000

[54] WELD-FREE GRIDS OR GRATINGS FOR BRIDGE DECKS

[75] Inventor: Ronald M. Mangone, New Kensington, Pa.

[73] Assignee: Mangone Enterprises, New Kensington, Pa.

[21] Appl. No.: 09/082,710

[22] Filed: May 21, 1998

[51] Int. Cl.[7] ..... E04C 2/42; E01D 19/12

[52] U.S. Cl. ..... 14/73; 404/45; 404/70; 52/668

[58] Field of Search ..... 14/73, 73.1; 52/318, 52/668; 404/45, 70

[56] References Cited

U.S. PATENT DOCUMENTS

| | | | |
|---|---|---|---|
| 2,114,773 | 4/1938 | Auten et al. | 72/71 |
| 2,128,753 | 8/1938 | Lienhard | 189/82 |
| 2,190,214 | 2/1940 | Nagin | 189/82 |
| 2,645,985 | 7/1953 | Beebe et al. | 94/30 |
| 2,834,267 | 5/1958 | Beebe | 94/30 |
| 3,125,009 | 3/1964 | Eberl | 14/73 |
| 3,260,023 | 7/1966 | Nagin | 52/181 |
| 4,452,025 | 6/1984 | Lew | 52/668 |
| 4,780,021 | 10/1988 | Bettigole | 404/72 |
| 4,865,486 | 9/1989 | Bettigole | 404/75 |
| 4,928,471 | 5/1990 | Bartley | 52/664 |
| 5,454,128 | 10/1995 | Kwon | 14/73 |
| 5,463,786 | 11/1995 | Mangone et al. | 14/73 |
| 5,509,243 | 4/1996 | Bettigole et al. | 52/334 |
| 5,595,034 | 1/1997 | Krysalka et al. | 52/318 |
| 5,604,949 | 2/1997 | Mangone | 14/73 |

*Primary Examiner*—Eileen Dunn Lillis
*Assistant Examiner*—Raymond W Addie
*Attorney, Agent, or Firm*—Andrew Alexander

[57] ABSTRACT

A weldless grating comprising a plurality of longitudinally extending primary load-bearing members having an upper portion, a lower portion and a web located between the upper portion and the lower portion, the primary load-bearing member having a plurality of spaced-apart, generally rectangular-shaped openings in the web, the openings in each of the primary load-bearing members being aligned with the openings in adjacent primary load-bearing members. A plurality of secondary and tertiary load bearing members are provided.

23 Claims, 7 Drawing Sheets

WELD-FREE GRIDS OR GRATINGS FOR BRIDGE DECKS

BACKGROUND OF THE INVENTION

This invention relates to grids or gratings useful for open or filled bridge decks, walkways, drain gratings and the like and more particularly, this invention relates to grids or gratings that are constructed and held together without welding.

In making prior gratings for bridge decks, whether the deck is open or filled with concrete, a certain amount of welding is performed to hold or bind the individual components together. That is, if the grid is used for open grating or open bridge deck, the main load-bearing members, secondary load-bearing members and tertiary load-bearing members are welded together, usually by puddle welding, to hold the members together and give the deck or grating strength. Even if the grid or deck is to be encased in concrete, still some welding is required to hold the assembly in a rigid configuration until the concrete hardens. If only minimal welding is performed, then the deck or grid work when encased in concrete has a decreased level of strength. Thus, for peak bridge strength, the various components of the grating or bridge deck must be fastened together to perform as a unit.

Various deck or grating systems have been proposed in the art, and the members comprising the grating deck are welded together. For example, U.S. Pat. No. 3,260,023 discloses a bridge floor and surfacing component. The bridge floor comprises parallel bearer bars and cross bars. The cross bars are pressure welded into the tops of the bearer bars.

U.S. Pat. No. 4,865,586 discloses a method of assembling a steel grid and concrete deck wherein the primary load-bearing bars are formed with openings to receive slotted secondary load-bearing bars that are passed through the primary load-bearing bars. However, the patent discloses that tack welds are used to temporarily hold the grating in its desired configuration. A concrete component encases at least the top surface of the grating base member and secures the elements of the grating base member together.

U.S. Pat. No. 2,128,753 discloses a steel floor construction having a series of parallel main bars in spaced relationship. Each of the main bars is provided with a plurality of rectangular-shaped openings. The openings are designed to permit the insertion thereon and the positioning of two cross bars. A third set of bars is placed in slots in the cross bars. After the members are assembled, the entire construction may be welded together to maintain the different parts in position.

U.S. Pat. No. 2,190,214 discloses a grating wherein a desired number of parallel spaced apart main bearer bars with intermediate bearer bars of less depth are placed between the main bearer bars. The main bearer bars and intermediate bearer bars are connected at their tops by cross bars secured thereto by electric pressure welding. Carrier bars which pass through slots in the main bearer bars are welded to the intermediate bearer bars. Also, carrier bars are welded to the main bearer bars.

U.S. Pat. No. 2,645,985 discloses an open floor grating having a plurality of longitudinal primary members, a plurality of transverse secondary members welded to and extending between the primary members. A plurality of tertiary members are welded to the secondary members. A rod is inserted through holes in the webs of the primary members and welded thereto.

U.S. Pat. No. 2,834,267 discloses a grating comprised of a plurality of spaced parallel main longitudinal bars and a plurality of spaced parallel lacing bars and tertiary longitudinal bars intermediate the main bars. Bottom bars are inserted through holes in the webbing of the main bars. The intersection between the lacing bars and the tertiary bars are welded and the bottom bar is welded to the webbing of the main bar.

U.S. Pat. No. 4,452,025 discloses a self-interlocking grille consisting of a plurality of metallic or plastic strips or flats or bars with certain types of notches and holes disposed along the length of the strip or flats or bars in a regular interval, which are used together with a plurality of rods in assembling a variety of interlocking grills.

U.S. Pat. No. 4,780,021 discloses an exodermic deck conversion method for converting a conventional grid deck to an exodermic deck. Tertiary load-bearing members are placed on top of the grating parallel to and between the primary load-bearing members. A plurality of shear connectors, such as vertical studs, are welded or attached to the surface of the grating. It will be seen from the above that in gratings and bridge decks, usually some form of welding or cement is used to hold the assembly together.

However, welding gratings or deck structures have the problem that toxic fumes are released into the atmosphere causing health hazards to the welders and pollution of the environment. Welding of structures such as bridge decks results in curling or deform ing of the deck as the welds cool. Thus, the design of the deck is complicated in that the curling or deforming must be accommodated in the design. Further, welding has the disadvantage that it is time consuming and often is the rate-determining step at which decks can be built. Welding also requires that the gratings or deck assemblies be maintained in jigs prior to starting the welding process. This is an additional, undesirable step in the process of making a bridge deck. Further, welds on bridge decks have the problem of cracking either with use or as the temperature cycles between winter and summer. It is desirable to rustproof gratings by galvanizing. However, because galvanizing is destroyed by welding, the welded grating or deck is often galvanized as a unit. However, this also results in temperature cyclization and warping of the bridge deck with the result that welds often break, detrimentally affecting the integrity of the deck.

Thus, it will be seen that there is a great need for an improved bridge deck or grating which will eliminate these problems and will provide for an improved deck or grating structure. The present invention provides such a structure.

SUMMARY OF THE INVENTION

It is an object of the present invention to provide an improved grating or grid.

It is another object of the invention to provide a grating or grid suitable for use on bridge decks.

It is a further object of the invention to provide an interlocking grating or grid fastened together without need for welding.

Still, it is another object of the invention to provide an interlocking grating which may be used for open bridge decks, may be utilized with a concrete component that encases at least a top portion of the grating or that uses a concrete overlay.

Yet, it is a further object of the invention to provide an interlocking grating for bridge decks and the like employing a primary load-bearing member and a secondary load-bearing member securely held together without welding.

And yet, it is an additional object of the invention to provide an interlocking grating for open or concrete encased bridge decks and the like employing a primary load-bearing member, a secondary member and a tertiary load-bearing member held together without welding.

These and other objects will become apparent from the drawings, specification and claims appended hereto.

In accordance with these objects, there is provided a weldless grating comprising a plurality of longitudinally extending primary load bearing members having an upper portion, a lower portion and a web located between the upper portion and the lower portion, the primary load bearing member having a plurality of spaced-apart, generally rectangular-shaped openings in the web, the openings in each of the primary load bearing members being aligned with the openings in adjacent primary load bearing members. A plurality of generally rectangular shaped, secondary load bearing members having an upper edge and a lower edge are provided. The secondary load bearing members have upwardly extending slots through the lower edge to provide bottom slots to coincide with web defining rectangular-shaped openings in adjacent primary load bearing members. The spaced-apart openings in the web have a size sufficient to accept the secondary load bearing members to provide a snug fit therewith. The secondary load bearing members are positioned in the spaced-apart openings in the web of the primary load bearing members. The bottom slots in the secondary load bearing member fit downwardly over the web forming a locking engagement with the web. The secondary load bearing members are provided with secondary downwardly extending slots through the upper edge, the secondary downwardly extending slots located between primary load bearing members. A plurality of tertiary load bearing members are positioned in the secondary slots in the secondary load bearing members. A rod extends through the primary load bearing members and the tertiary load bearing members locking the tertiary load bearing members in the slots in the secondary load bearing members and locking the secondary load bearing members in the openings in the primary load bearing members to form the weldless grating.

DETAILED DESCRIPTION OF PREFERRED EMBODIMENTS

Figure 1:
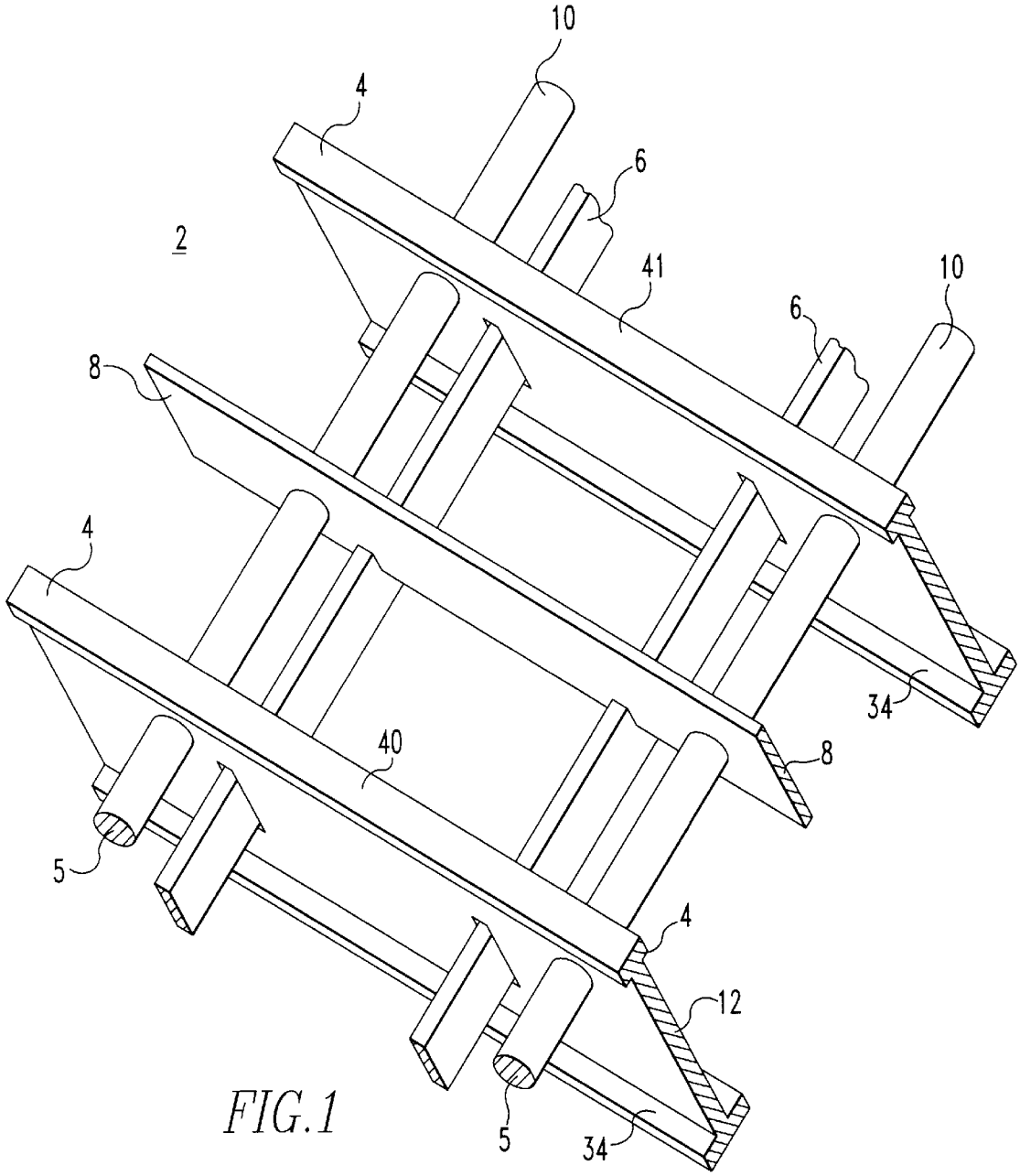
FIG. 1 is a perspective view of a grating in accordance with the invention showing secondary load bearing members locked in the web of a primary load-bearing member.

Referring now to FIG. 1, there is shown a grating in accordance with the present invention. Grating or grid 2 is comprised of a plurality of primary load-bearing bars 4, a plurality of transverse secondary bars 6, a plurality of tertiary members 8 shown running substantially parallel to the primary load-bearing members 4. Rods 10 are shown laced through web 12 of primary load-bearing member 4 and through tertiary bars 8.

Figure 2:
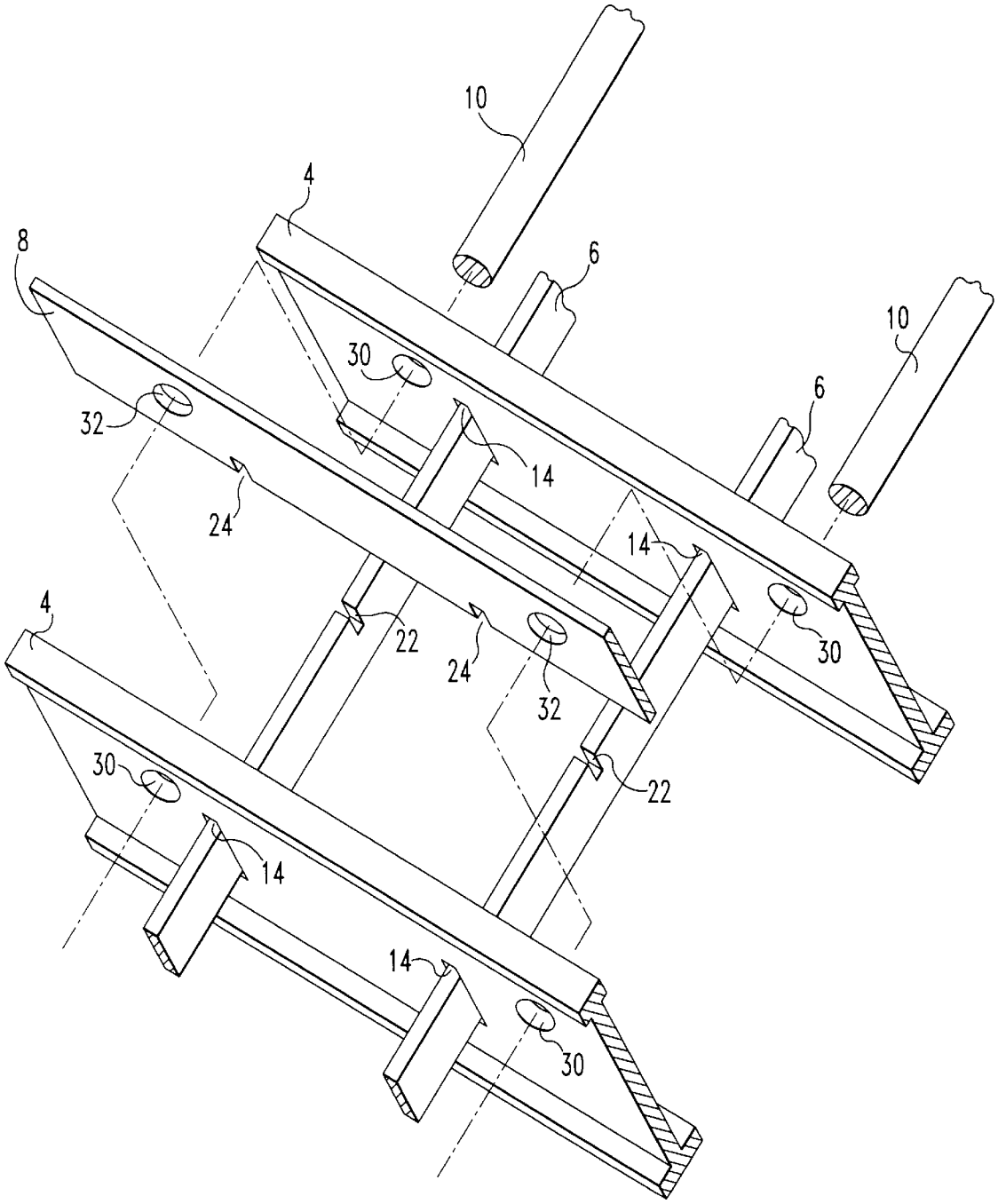
FIG. 2 is a perspective view showing the parts of the grating of FIG. 1 in partially unassembled relationship.
Figure 3:
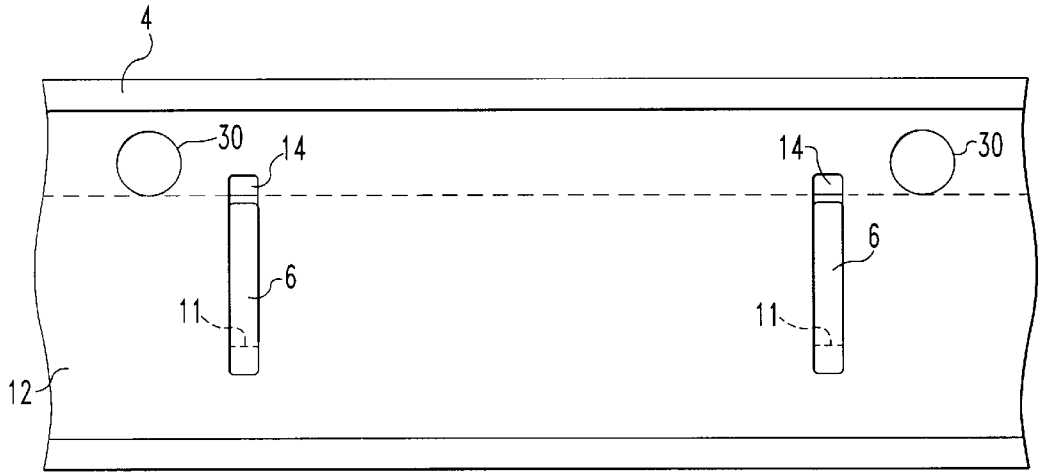
FIG. 3 is an elevational view of the primary load-bearing members showing the ends of rods and ends of the secondary load bearing members projecting through the slots in the primary load bearing member.

In FIG. 2, the primary load-bearing members 4 and transverse or secondary load-bearing members 6 are shown in partial unassembled relationship along with tertiary members or tertiary load bearing members 8 and rod 10. It will be seen that primary load-bearing members 4 have openings 14 (see FIG. 3) cut out to receive secondary member 6. Openings 14 are preferably rectangular shaped as shown in FIG. 3. However, any shaped opening that accommodates the secondary load bearing member and is locked in place in accordance with the invention is contemplated within the purview of the invention. Thus, each primary load-bearing member 4 has a plurality of rectangular-shaped openings 14 to receive each secondary load-bearing member 6. Further, each secondary load-bearing member 6 has a plurality of slots 16 (see FIG. 4) that align with web material 12 of primary load-bearing member 4 when assembled. In FIG. 3, ends of secondary load-bearing member 6 are shown with slots 16 engaging web 12 at bottom 11 (shown in outline form) of opening 14.

Figure 4:
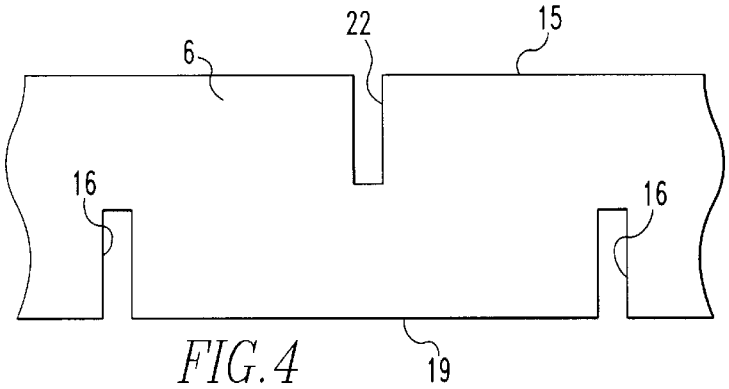
FIG. 4 is a side view of the secondary load bearing member.

With respect to secondary load-bearing members 6, these are shown having a generally rectangular cross-sectional configuration for convenience. However, as noted, other cross-sectional shapes may be utilized, e.g., square. Secondary load-bearing members 6 are shown in FIG. 4 in a preferred embodiment having two slots 16 through bottom surface 19. Further, secondary load-bearing member 6 may be provided with a slot 22 on top surface 15 to engage tertiary load bearing member 8 when the grating is assembled. Slots 16 and 22 are formed to provide a snug fit then engaged or locked on web 12 and tertiary load bearing member 8. Further, these slots may be tapered from edge, e.g. 15, to the bottom of the slot to provide for improved engagement and minimize play between the mating members.

Figure 8:
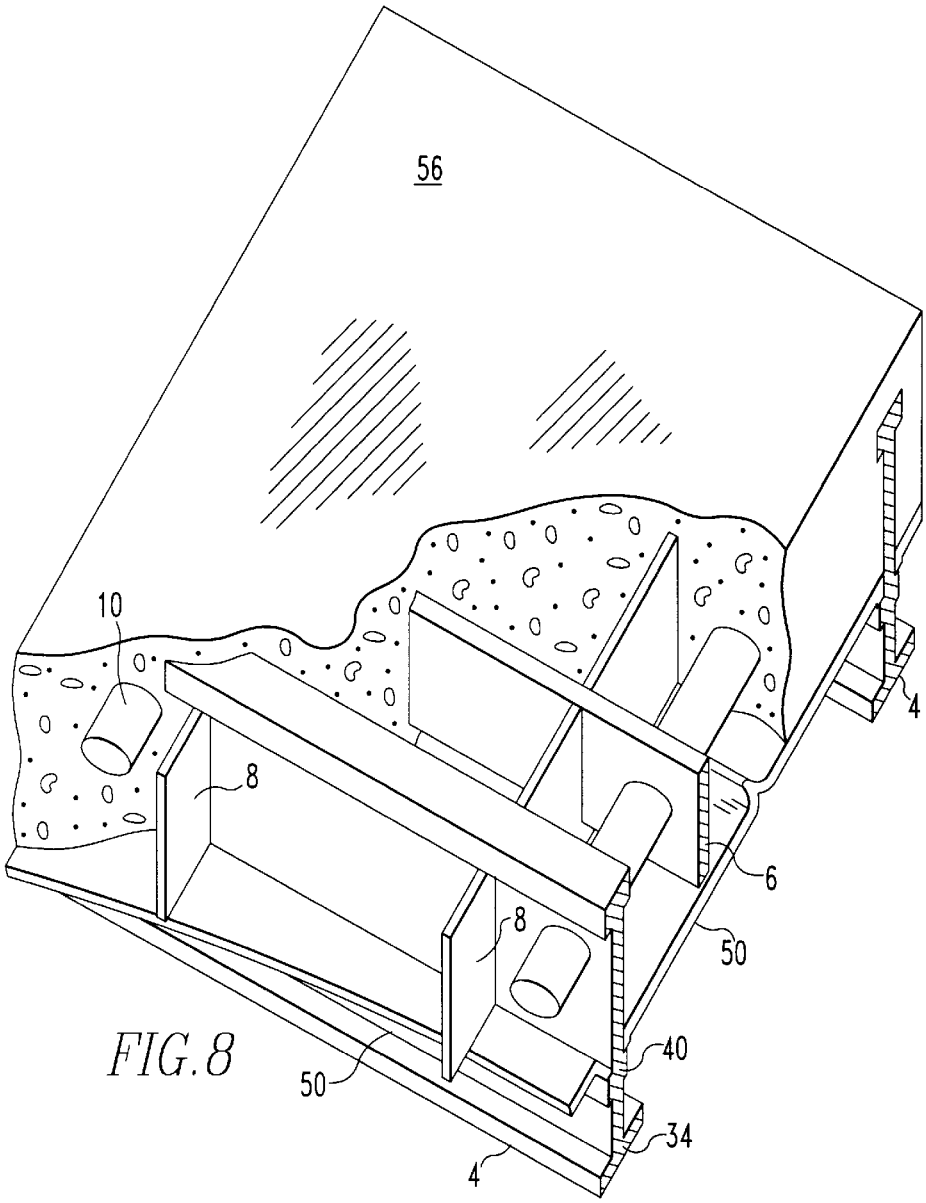
FIG. 8 is a perspective view showing the parts in FIG. 6 showing concrete contained in the top portion of the grating.

Primary load-bearing member 4 is generally rectangular in cross-section and may have ribs or flanges projecting from either or both sides or member 4 may have an I-beam configuration as shown in FIGS. 1 or 8. The side view of a primary load-bearing member 4 showing openings 14 formed in web 12 in shown in FIG. 3. Two openings are shown for illustration purposes. For purposes of locking secondary load-bearing member in primary load-bearing member 4, secondary load-bearing member 6 is inserted into primary load-bearing member 4 having slots 16 pointing downwardly. Thus, opening 14 must be at least slightly larger than secondary load-bearing member 6. When opening 14 has these dimensions, then secondary load-bearing member 6 can be inserted through opening 14 until proper alignment with slots 16 is reached. When secondary load-bearing member 6 is inserted to the extent required and proper alignment with slots 16 and web 12 is reached, then secondary load-bearing member 6 is pushed downwardly in order that slots 16 lock onto web 12 at bottom 11 of opening 14. It should be understood that the closer the tolerance maintained between the dimensions of slot 16 and web 12, the more rigidity is maintained in the grating. It will be appreciated that there is a balance in the tolerances of all the slots and thickness of the web inserted therein and ease of assembly of the grating. That is, the tighter the tolerances maintained, the more rigid the grating. Slots 16 may be tapered for ease of assembly and yet provide for a tight fit.

Thus, web 12 is engaged by or locked into slot 16 on bottom edge 19 of secondary load-bearing member 6. While secondary load-bearing member 6 is locked into primary load-bearing member 4 using slots 16, primary load-bearing member 4 is prevented from moving in the direction of adjacent primary load-bearing member 4. In this embodiment of the invention, secondary load-bearing member 6 is maintained in a substantially vertical or upright position.

It should be noted that different shapes may be used for opening 14 and secondary load-bearing member 6 and different methods of assembly may be used. Further different methods of interlocking may be employed. All of these are contemplated within the purview of the invention.

Figure 5:
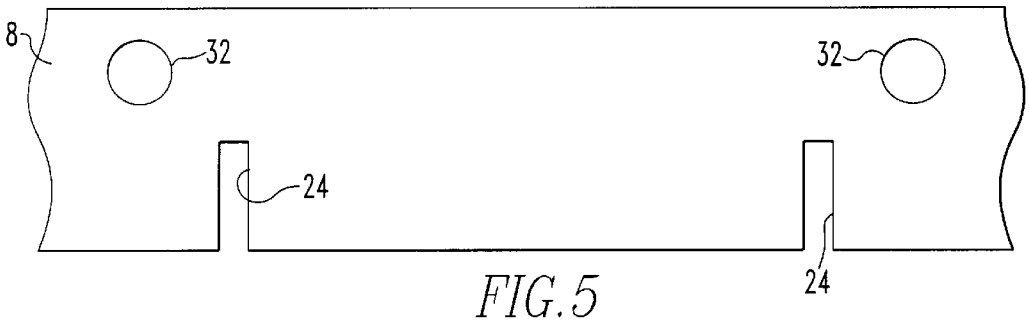
FIG. 5 is a side view of the tertiary load bearing member.

Tertiary load-bearing members 8 (FIG. 5) may be provided with a plurality of slots 24 for alignment with slots 22 (FIG. 4) of secondary load-bearing member 6. In one embodiment of the assembly, slots 24 of tertiary load-bearing member 8 line up with slots 22 of secondary load-bearing member 6 to provide a planar surface as defined by the top surfaces or edges of primary load-bearing members 4 and tertiary load-bearing members 8. To provide a planar surface, slots 24 and 22 together should have a depth that permits sufficient engagement with each other. However, to the extent that the top edge of tertiary load-bearing member 8 is at the same level as the top edge of primary load-bearing member 4, if it is desired to have tertiary load-bearing member 8 project above the edge of primary load-bearing member 4, then slot 22 may be shallower. Also, any combination of slot depths may be used to provide either a planar surface or a ridge or rough surface for traction. Similarly, slots 22 may be eliminated if slots 24 are sufficiently deep in member 8.

Thus, it will be seen that in assembly, primary load-bearing members 4 are first placed or fixed in position and then secondary load-bearing members 6 are laced through openings 14 of primary load-bearing members 4. When slots 16 are in alignment with web 12, secondary load-bearing member 6 is forced downwardly to ensure that slots 16 engage web 12 to lock it in position and prevent lateral movement. Thereafter, tertiary load-bearing members 8 are placed across secondary load-bearing members 6 with slots 22 and 24 being aligned for engagement.

For purposes of locking the assembly comprised of primary load-bearing member 4, secondary load bearing members 6 and tertiary load-bearing members 8, an apertures 30 are provided in primary load bearing members 4 (FIG. 3), the aperture being formed to have an axis substantially parallel to secondary load-bearing members 6. Likewise, tertiary load-bearing members 8 have apertures 32 formed so as to be in alignment with apertures 30 of primary load-bearing members 4 when the grating is assembled. Rod 10 then is fitted through a first aperture 30 in a first primary load-bearing member 4, then through apertures 32 of tertiary load-bearing member 8 and finally through a second aperture 30 in second primary load-bearing member 4. In this assembly, end 5 of rod 10 may be bent, fitted with a pin or nut to ensure that it does not move. Thus, after having secured rod 10, primary load -bearing members 4, secondary load-bearing members 6 and tertiary load-bearing members 8 are locked together to form a unit grating, grid work, fence or railings without the attendant problems inherent with welding. Further, because of the additional rod used, the strength of the grating structure is improved dramatically. It will be appreciated that one rod or more can be used between each set of secondary load-bearing members 6. Further, fewer rods can be used. That is, in the present invention rods 10 can be selectively placed between secondary load-bearing members 6. For example, in the present invention, high strength grating can be obtained when rods 10 are used between every other set of secondary load-bearing members 6.

With respect to rod 10, it will be noted that a round member has been illustrated. However, any cross-sectional configuration may be used.

In FIG. 1, primary load-bearing member 4 is shown with a lower flange 34, a web portion 12 and second flange 41. However, primary load-bearing members 4 can have other cross-sectional configurations that may be used.

Secondary load-bearing members 6 generally has a depth less than the depth of web 12 of primary load-bearing members 4, and tertiary load-bearing members 8 can have a depth more or less than the depth of secondary load-bearing members 6. Further, it should be that if tertiary load-bearing members 8 are sufficiently deep, then notch or slots 24 sufficient depth to accommodate the full depth of the secondary load-bearing members 6 without slots 22 being provided in secondary load-bearing members 6. Rod 10 can provide sufficient resistance to sideways movement of tertiary load-bearing members 8.

Figure 6:
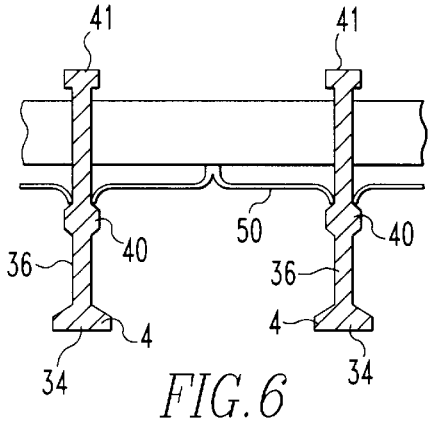
FIG. 6 is an end view of primary load bearing members and secondary load bearing member mounted on upper flanges and pans to contain a layer of concrete covering a top portion of the grating.
Figure 9:
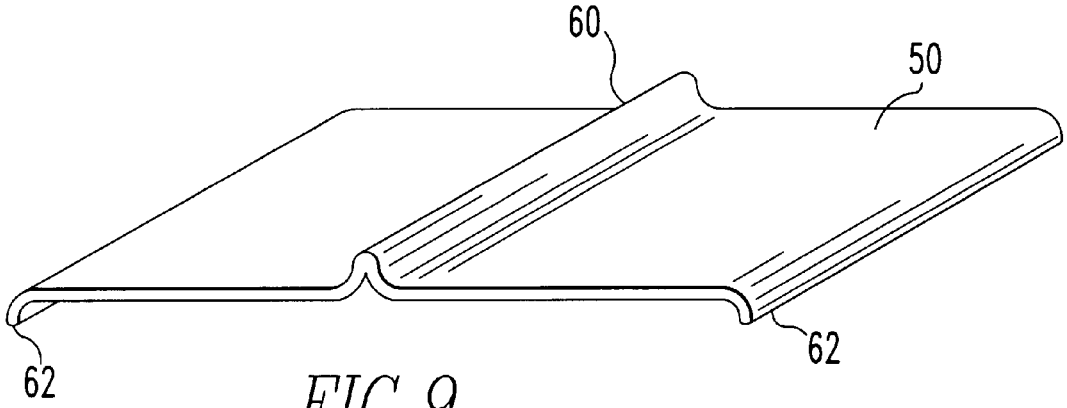
FIG. 9 is a perspective view of the pan of FIG. 6.
Figure 10:
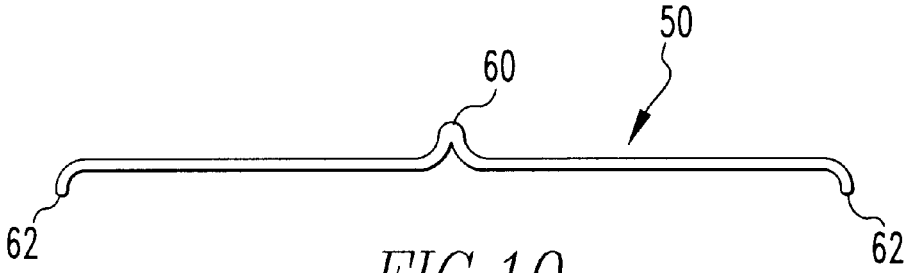
FIG. 10 is an end view of the pan of FIG. 6.

When it is desired to encase at least a portion of the grating in concrete, a pan or sheet member 50 is positioned between primary load-bearing members 4 on rib 40 as shown in FIG. 6. Pan 50 is formed to extend the length of primary load-bearing members 4 and to rest on ribs 40. Thus, pan 50 can be shaped substantially as shown in FIGS. 9 and 10. That is, pan 50 is provided with a rib 60 which extends the length of pan 50 in a direction generally parallel to primary load-bearing member 4. Further, preferably pan 50 is generally curved or shaped concave upwardly towards rib 60 as shown in FIGS. 9 and 10. Rib 60 provides for stiffness in pan 50. In addition, the height from edge 62 to the top of ridge 60 should be controlled. That is, in the preferred embodiment, when concrete is to be used as a wear surface or to partially encapsulate grating 2, pan 50 is positioned between primary load-bearing member 4. Edges 62 of pan 50 rest on the upper surface of rib 40, as shown in FIG. 6, for example. When secondary load-bearing member 6 is locked in position, bottom or lower side 19 of secondary load-bearing member 6 can be made to contact ridge 60 to secure pan 50 in place by friction. Thus, the grating can be shipped to the job site without pans 50 moving or dropping out of the grating. It should be noted that welding pans 50 in place is undesirable because of warpage that occurs. The warpage results in uneven thickness of concrete and also in spaces between the rib and the pan which results in wet concrete seeping or dripping onto the surfaces below. The assembled grating in accordance with the invention has a rigid configuration without substantially any movement of the members. Thus, for example, because primary load-bearing members do not move or wobble, the pans can be placed on or inserted between the primary load-bearing members prior to shipping.

Figure 7:
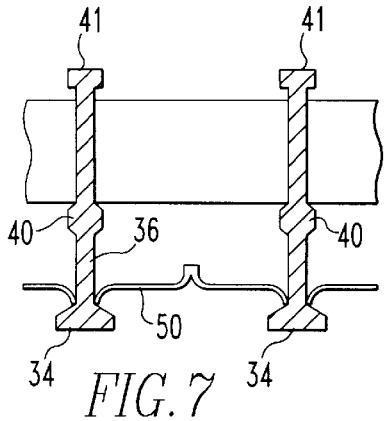
FIG. 7 is an end view of a grating similar to FIG. 1 with a pan for containing wet concrete positioned on lower flanges to almost completely encapsulate the grating.

If it is desired to encase substantially the depth of the grating in concrete, pan 50 can be located, as shown in FIG. 7.

FIG. 8 is a schematic showing concrete 56 provided in the upper portion of the grating.

It should be understood that while the grating of the invention has been shown encasing a top portion of the grating (FIG. 8), the concrete can extend above and below the grating, if desired. That is, the grating can be substantially encapsulated with concrete. In another embodiment, a concrete layer can be anchored on top of the grating.

Figure 11:
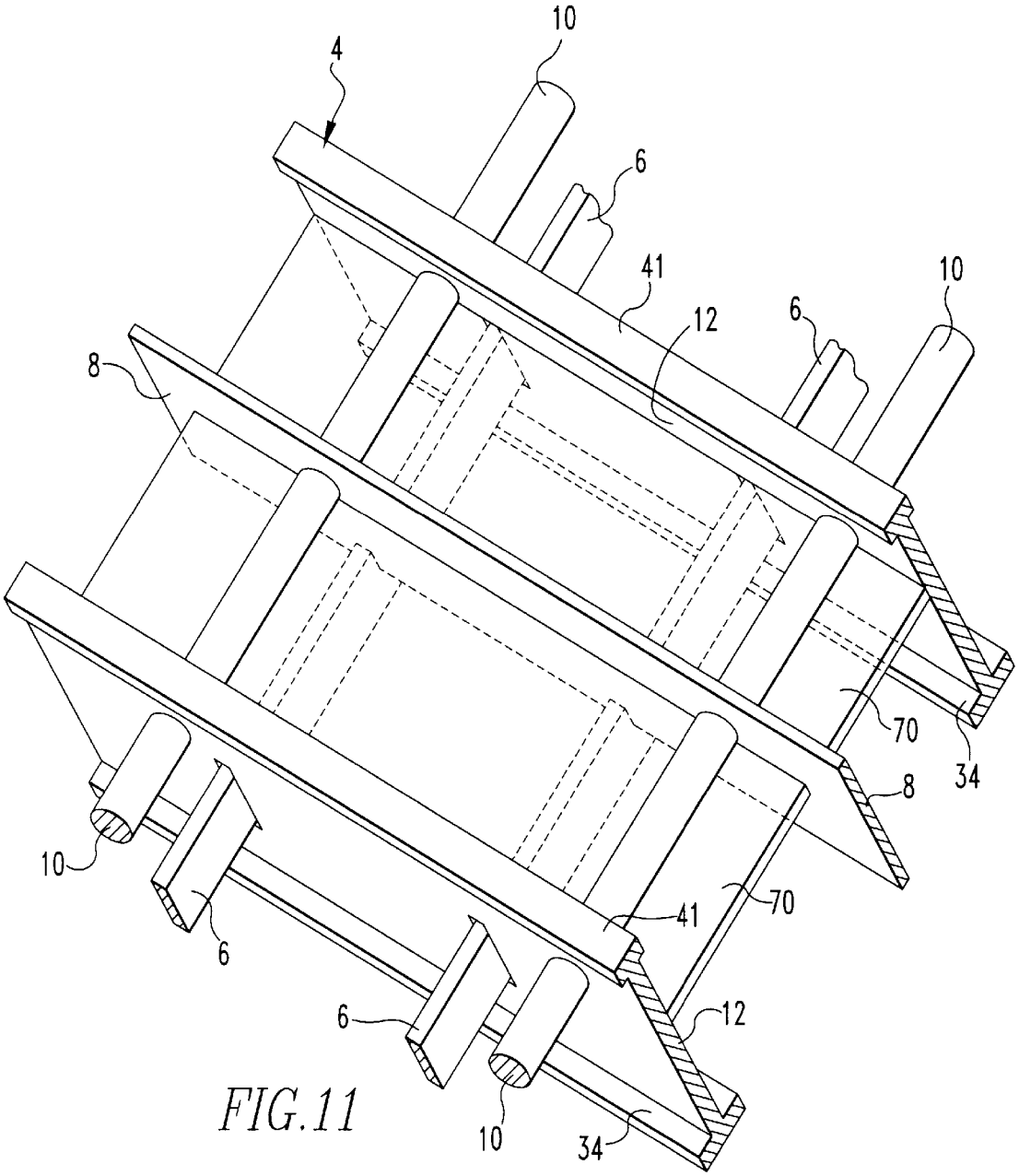
FIG. 11 is a perspective view similar to FIG. 1 with a flat pan locked in the upper region of the grating.

If it is desired to provide a concrete wear surface where only a minimal amount of concrete is anchored in grating 2 of FIG. 1, then a flat pan 70 can be utilized as shown in FIG. 11. Flat pan 70 is inserted below rod 10 and over secondary load-bearing member 6. Further, pan 70 extends from web 12 to tertiary load-bearing member 8 to provide a snug fit therebetween. Sealing compound may be added to web 12 or tertiary load-bearing member 8, as desired. In this embodiment, pan or strip 70 is anchored between rod 10 and secondary load-bearing member 6.

Figure 12:
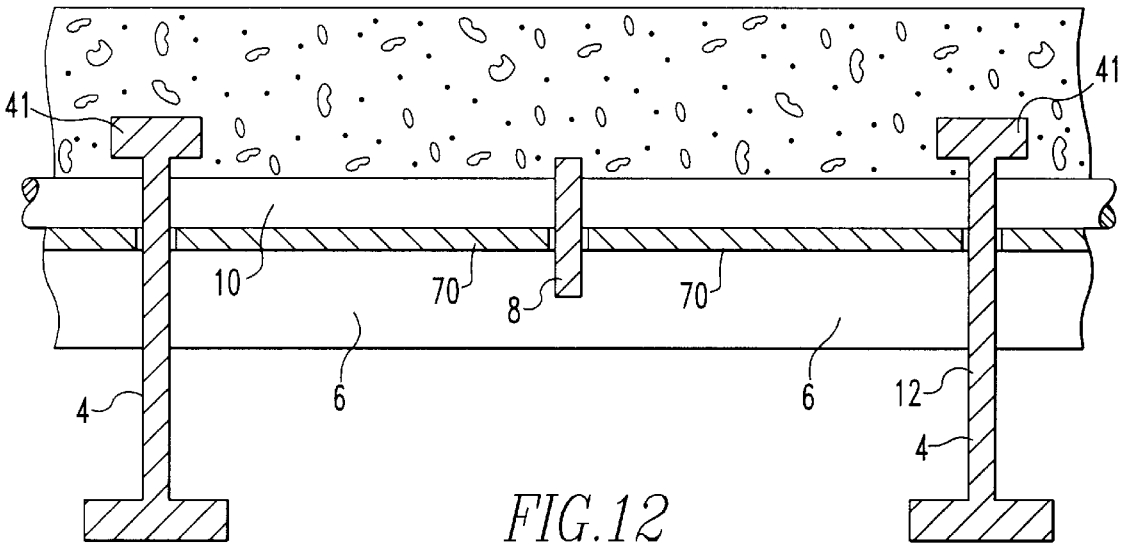
FIG. 12 is an end view of the grating of FIG. 11 showing a layer of concrete on the top of the grating.

FIG. 12 shows an end view of primary load-bearing member 4 and tertiary load-bearing member 8 with a layer of concrete extending from pan 70 to above primary load-bearing members 4. An end of pan 70 is shown extending from web 12 to tertiary load-bearing member 8. Further, pan 70 is shown supported by secondary load-bearing member 6 and anchored or held beneath rod 10. In this embodiment, the concrete is anchored to the top of grating 2 by means of flanges 41. If desired, rod 10 can be located or spaced above pan 70 to permit wet concrete to flow underneath rod 10, thereby providing further anchoring means.

While the invention has been described with respect to a grating employing a three-member system and a locking rod, the invention contemplates grating fabricated using two rails such as the primary load-bearing members and secondary load-bearing members. When the grating is fabricated using two rails, then locking rod 10 is inserted through both rails in a diagonal direction.

It will be seen that gratings in accordance with the present invention overcome the disadvantages of welded gratings referred to earlier. However, even though welds can be applied to the grating of the present invention, welding is believed to be more detrimental than advantageous because welding tends to cause embrittlement and, therefore, provides a site for failure such as fatigue failure. However, the term weldless as used herein can include minor welding, for example, if such were used to hold rod 10 in place, and such is contemplated within the purview of the invention.

Further, while the invention has been depicted showing primary load-bearing members having flanges, the invention contemplates gratings fabricated using plain members for all three load-bearing members; and in certain gratings, the three members can have the same dimensions.

The gratings of the invention can be fabricated from metals such as steels, carbon steel, stainless steels and aluminum alloys or from plastics such as fiberglass-reinforced plastics.

In the present invention, if steel members are used, they may be galvanized prior to assembly or after assembly. If galvanized before assembly, touch-up may have to be used to cover scratches resulting from assembly. Further, in the present invention, the slots should be dimensioned to provide for a snug fit to minimize collection of debris such as salts that cause corrosion, particularly in open gratings.

While the invention has been described in terms of preferred embodiments, the claims appended hereto are intended to encompass other embodiments which fall within the spirit of the invention.

What is claimed is:

1. A weldless grating comprising:

(a) a plurality of longitudinally extending primary load-bearing members having an upper portion, a lower portion and a web located between said upper portion and said lower portion, the primary load-bearing member having a plurality of spaced-apart, closed rectangular-shaped openings in said web, the openings in each of said primary load-bearing members being aligned with the openings in adjacent primary load-bearing members;

(b) a plurality of generally rectangular shaped, secondary load-bearing members having an upper edge and a lower edge, the secondary load-bearing members provided with upwardly extending slots through the lower edge to provide bottom slots to coincide with said web defining said rectangular-shaped openings in adjacent primary load-bearing members, said spaced-apart openings in said web having a size sufficient to accept said secondary load-bearing members to provide a snug fit therewith, the secondary load-bearing members positioned in the spaced-apart openings in said web of the primary load-bearing members, said bottom slots in said secondary load-bearing member fitting generally downwardly over said web forming a locking engagement with said web defining said rectangular shaped openings in said primary load-bearing members, the secondary load-bearing members provided with secondary downwardly extending slots through said upper edge, said secondary downwardly extending slots located between primary load-bearing members;

(c) a plurality of tertiary load-bearing members positioned in the secondary slots in the secondary load-bearing members; and (d) a rod extending through said primary load-bearing members and said tertiary load-bearing members locking said tertiary load-bearing members in the slots in said secondary load-bearing members and locking said secondary load-bearing members in the openings in said primary load-bearing members to form said weldless grating.

2. The grating in accordance with claim 1 wherein each of said tertiary load-bearing members has a tertiary bottom slot at the point of intersection with said secondary load-bearing members, the tertiary bottom slot fitting snugly over said secondary load-bearing members.

3. The grating in accordance with claim 1 wherein said primary load-bearing members have a generally rectangular cross section.

4. The grating in accordance with claim I wherein said primary load-bearing members are positioned substantially parallel to each other, said secondary load-bearing members are positioned transverse to said primary load-bearing members and said tertiary load-bearing members are positioned substantially parallel to said primary load-bearing members.

5. The grating in accordance with claim 1 wherein said rod extends substantially parallel to said secondary load-bearing members.

6. A weldless grating comprising:

(a) a plurality of substantially parallel longitudinally extending primary load-bearing members having an upper portion, a lower portion and a web located between said upper portion and said lower portion, the primary load-bearing member having a plurality of spaced-apart, closed rectangular-shaped openings in said web, the openings in each of said primary load-bearing members being aligned with the openings in adjacent primary load-bearing members;

(b) a plurality of generally rectangular shaped, secondary load-bearing members having an upper edge and a lower edge, the secondary load-bearing members provided with upwardly extending slots through the lower edge to provide bottom slots to coincide with said spaced-apart openings in said web, said spaced-apart openings in said web having a size sufficient to accept said secondary load-bearing members to provide a snug fit therewith, the secondary load-bearing members positioned in the aligned openings in said web of the primary load-bearing members, said bottom slots in said secondary load-bearing member forming a locking engagement with said web defining rectangular-shaped openings in said primary load-bearing members, the secondary load-bearing members provided with secondary downwardly extending slots through said top edge, secondary downwardly extending slots located between primary load-bearing members, the secondary downwardly extending slots in each of said secondary load-bearing members being aligned with corresponding downwardly extending slots in adjacent secondary load-bearing members;

(c) a plurality of tertiary load-bearing members positioned in the secondary slots in the secondary load-bearing members, the tertiary load-bearing members having tertiary bottom edges having upwardly extending tertiary bottom slots extending through said tertiary bottom edges to form tertiary bottom slots positioned in alignment with the secondary downwardly extending slots in said secondary load-bearing member to permit said secondary load-bearing members and said tertiary load-bearing members to fixedly engage each other; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating.

7. The grating in accordance with claim 6 wherein the members comprise steel members.

8. The grating in accordance with claim 6 wherein the members comprise an aluminum alloy member.

9. The grating in accordance with claim 6 wherein the members are substantially rectangular shaped in cross section.

10. The grating in accordance with claim 6 wherein the primary load-bearing members have flanges located below said bottom edges of said secondary load-bearing members, said flanges projecting towards adjacent primary load-bearing members and extending longitudinally along said primary load-bearing member, said flanges located on an opposite wall of an adjacent primary load-bearing members to provide a support for a pan positioned between said primary load-bearing members and resting on said flange to provide a bottom on said grating to contain wet concrete.

11. The grating in accordance with claim 6 wherein the rod is circular in cross section.

12. The grating in accordance with claim 6 wherein said secondary load-bearing members are positioned substantially parallel to each other and positioned substantially at right angles to said primary load-bearing members and said tertiary load-bearing members are positioned substantially parallel to said primary load-bearing members.

13. The grating in accordance with claim 6 wherein said rod extends substantially parallel to said secondary load-bearing members.

14. The grating in accordance with claim 6 including a pan comprised of a flat generally rectangular-shaped strip positioned between said primary load bearing members, located on top of said secondary load bearing members and underneath said rod.

15. A concrete module comprising a weldless grating at least partially encapsulated in a body of concrete or overlaid with a body of concrete, the weldless grating comprising:

(a) a plurality of longitudinally extending primary load-bearing members having an upper portion, a lower portion and a web located between said upper portion and said lower portion, the primary load-bearing member having a plurality of spaced-apart, closed rectangular-shaped openings in said web, the openings in each of said primary load-bearing members being aligned with the openings in adjacent primary load-bearing members;

(b) a plurality of generally rectangular shaped, secondary load-bearing members having an upper edge and a lower edge, the secondary load-bearing members provided with upwardly extending slots through the lower edge to provide bottom slots to coincide with said spaced-apart openings in said web, said spaced-apart openings in said web having a size sufficient to accept said secondary load-bearing members too provide a snug fit therewith, the secondary load-bearing members positioned in the spaced-apart openings in said web of the primary load-bearing members, said bottom slots in said secondary load-bearing member fitting generally downwardly over said web forming a locking engagement with said web defining said rectangular-shaped openings in said primary load-bearing members, the secondary load-bearing members provided with secondary downwardly extending slots through said upper edge, said secondary downwardly extending slots located between primary load-bearing members;

(c) a plurality of tertiary load-bearing members positioned in the secondary slots in the secondary load-bearing members; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating.

16. The concrete module in accordance with claim 15 wherein each of said tertiary load-bearing members has a tertiary bottom slot at the point of intersection with said secondary load-bearing members, the tertiary bottom slot fitting snugly over said secondary load-bearing members.

17. The concrete module in accordance with claim 15 wherein said primary load-bearing members have a generally rectangular cross section.

18. The concrete module in accordance with claim 15 wherein said primary load-bearing members are positioned substantially parallel to each other, said secondary load-bearing members are positioned transverse to said primary load-bearing members and said tertiary load-bearing members are positioned substantially parallel to said primary load-bearing members.

19. The concrete module in accordance with claim 15 wherein said rod extends substantially parallel to said secondary load-bearing members.

20. The concrete module in accordance with claim 15 wherein the rod is circular in cross section.

21. A concrete module comprising a grating at least partially encapsulated in a body of concrete or overlaid with a body of concrete, the weldless grating comprising:

(a) a plurality of longitudinally extending primary load-bearing members having an upper portion, a lower portion and a web located between said upper portion and said lower portion, the primary load-bearing member having a plurality of spaced-apart, closed rectangular-shaped openings in said web, the openings in each of said primary load-bearing members being aligned with the openings in adjacent primary load-bearing members;

(b) a plurality of secondary, rectangular-shaped load-bearing members having an upper edge and a lower edge, the secondary load-bearing members provided with upwardly extending slots through the lower edge to provide bottom slots located to coincide with web defining said rectangular-shaped openings in adjacent load-bearing members, said spaced-apart openings in said web having a size sufficient to accept said secondary load-bearing members to provide a snug fit therewith, the secondary load-bearing members positioned in the aligned openings in said web of the primary load-bearing members, said top and bottom slots in said secondary load-bearing members forming a locking engagement with said web surrounding said openings in said primary load-bearing members, the secondary load-bearing members provided with secondary downwardly extending slots through said top edge, secondary downwardly extending slots located between primary load-bearing members, the secondary downwardly extending slots in each of said secondary load-bearing members being aligned with downwardly-extending slots in adjacent secondary load-bearing members;

(c) a plurality of tertiary load-bearing members positioned in the secondary slots in the secondary load-bearing members, the tertiary load-bearing members having tertiary bottom edges having upwardly extending tertiary bottom slots extending through said tertiary bottom edges to form tertiary bottom slots positioned in alignment with the secondary downwardly extending slots in said secondary load-bearing member to permit said secondary load-bearing members and said tertiary load-bearing members to fixedly engage each other; and (d) a rod extending through said tertiary load-bearing members and said primary load-bearing members locking said tertiary load-bearing members in the slots in said secondary load-bearing members and locking said secondary load-bearing members in the openings in said primary load-bearing members to form said weldless grating.

22. The module in accordance with claim 21 wherein said module is a bridge deck or bridge ramp module.

23. The grating in accordance with claim 21 wherein said secondary load-bearing members are positioned substantially parallel to each other and positioned substantially at right angles across said primary load-bearing members and said tertiary load-bearing members are positioned substantially parallel to said primary load-bearing members.

* * * * *